United States Patent [19]

Tabler et al.

[11] 4,287,049

[45] Sep. 1, 1981

[54] RECLAIMING USED LUBRICATING OILS WITH AMMONIUM SALTS AND POLYHYDROXY COMPOUNDS

[75] Inventors: Donald C. Tabler; Marvin M. Johnson, both of Bartlesville, Okla.

[73] Assignee: Phillips Petroleum Co., Bartlesville, Okla.

[21] Appl. No.: 118,702

[22] Filed: Feb. 5, 1980

[51] Int. Cl.[3] ..... C10M 11/00

[52] U.S. Cl. ..... 208/180; 208/181; 208/251 H

[58] Field of Search ..... 208/180, 181, 182, 251 H

[56] References Cited

U.S. PATENT DOCUMENTS

| | | | |
|---|---|---|---|
| 2,545,806 | 3/1951 | Davis | 208/252 |
| 4,151,072 | 4/1979 | Nowack et al. | 208/182 |

FOREIGN PATENT DOCUMENTS

| | | | |
|---|---|---|---|
| 83558 | 6/1920 | Fed. Rep. of Germany | 208/180 |
| 1228293 | 8/1960 | France | 208/180 |
| 55-22006 | 8/1980 | Japan | 208/181 |

*Primary Examiner*—Brian E. Hearn

[57] ABSTRACT

A process for the reclaiming of used lubricating oils, particularly mixtures containing used oil from diesel engine crank cases, is provided to facilitate the separation of an oil phase from residual product in the production of an intermediate low-ash oil or a high-grade lube oil stock which method comprises: (a) contacting the used oil with an aqueous ammonium salt treating agent in the presence of a polyhydroxy compound, (b) removing a major portion of water, and (c) separating the oil phase from the resultant residual product. Optionally, (d) recovering the low-ash product of step (c) for use as a fuel oil, in grease formulations, or in the preparation of lubricating oil formulations. Optionally, the low-ash product of step (d) is (e) subjected to hydrotreating and thereafter (f) stripped.

7 Claims, 1 Drawing Figure

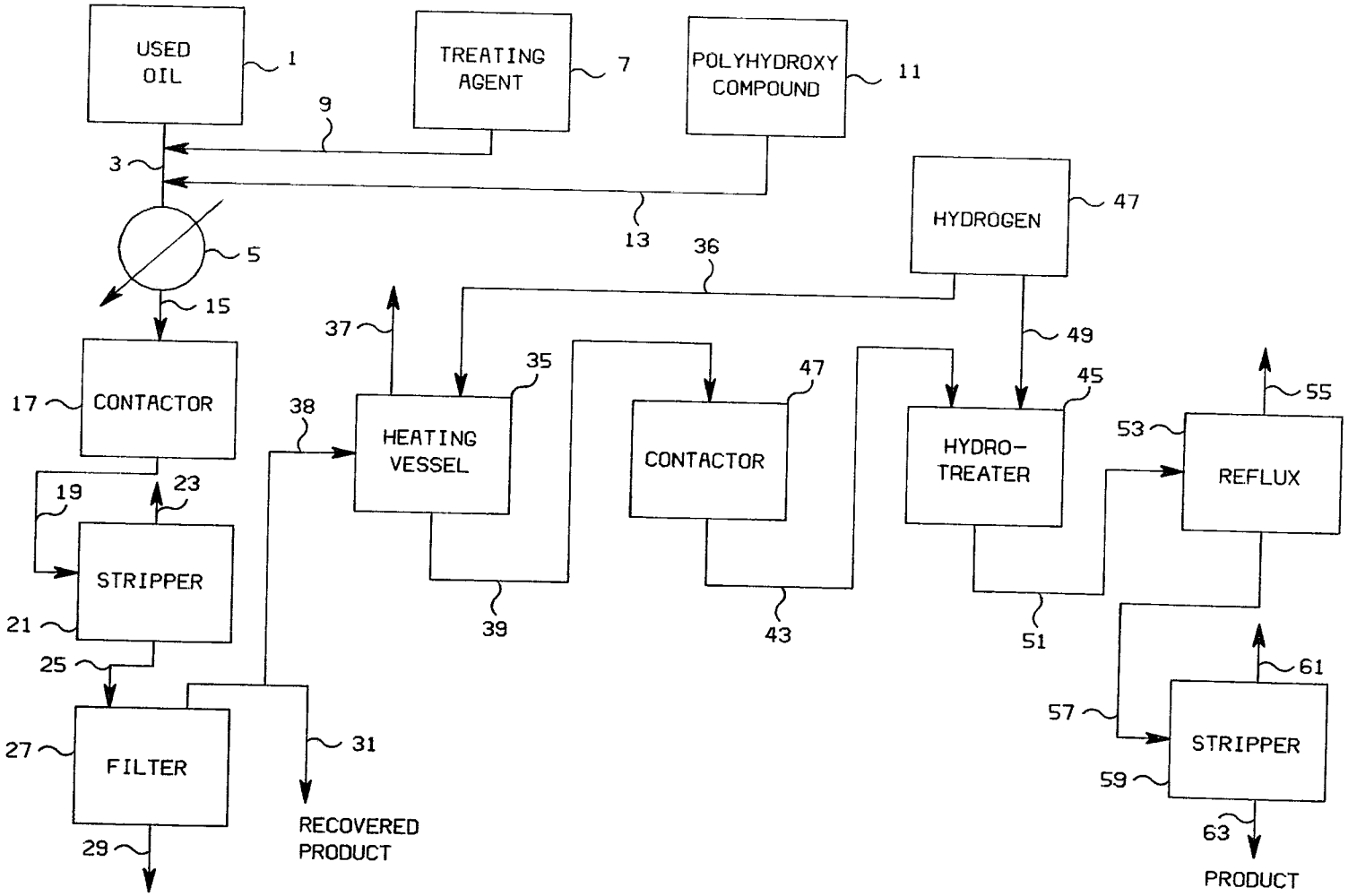
USED OIL
TREATING AGENT
POLYHYDROXY COMPOUND
HYDROGEN
HYDRO-TREATER
REFLUX
STRIPPER
PRODUCT
CONTACTOR
HEATING VESSEL
CONTACTOR
STRIPPER
FILTER
RECOVERED PRODUCT
1
3
5
7
9
11
13
15
17
19
21
23
25
27
29
31
35
36
37
38
39
43
45
47
49
51
53
55
57
59
61
63

RECLAIMING USED LUBRICATING OILS WITH AMMONIUM SALTS AND POLYHYDROXY COMPOUNDS

BACKGROUND OF THE INVENTION

This invention relates to treatment of used lubricating oils.

In one of its aspects this invention relates to the removal of impurities of used lubricating oils. In another of its aspects this invention relates to the removal of additive systems from used lubricating oils to provide a lube oil stock. In another aspect of the invention it relates to removal and separation of specific contaminants such as gasoline, metal components, and nitrogen, sulfur and oxygen compounds in a process for treating used lubricating oils. In still another aspect of the invention it relates to facilitating the separating of the oil phase from residual product in the treatment of used lubricating oils.

In recent years the performance of lubricating oils has been greatly improved by the addition of a number of compounds such as detergents, pour point depressants, oxidation inhibitors and viscosity index improvers. The purpose of using modern detergent additives, such as calcium and barium salts of alkyl benzene sulfonic acids and ashless type detergents such as alkyl-substituted succinimides, is to suspend the resins that normally form in oil while in use as well as carbon, dirt, wear metals and other impurities in the oil in the engine so that these suspended impurities remain with oil drained from the engine during oil changes and are eliminated in this manner.

The presence of the suspended impurities and the engine additives has greatly increased the task of reclaiming the used engine oils. The problem is accentuated by the presence of oil from diesel engines in mixtures of used engine oils. These oils, probably because of additional carbon or soot, are particularly difficult to filter after treatment which precipitates other impurities from the used oil. It has now been discovered that the presence of certain polyhydroxy compounds in the reaction mixture for the treatment of used lubricating oil with an aqueous ammonium salt treating agent facilitates the filtering of the precipitate produced by the reaction of used oil and the treating agent.

Since service stations tend to place all crank case drainings into a common tank practically all lubricating oil available for re-refining or reclaiming processes has not only high-detergency properties, but also contains crank case drainings from diesel engines. The present invention allows more efficient treating of crank case drainings received in large lots by re-refining or reclaiming processers.

It is, therefore, an object of this invention to provide a means for facilitating the filtration step in a universally applicable system for reclaiming used lubricating oils.

It is another object of this invention to provide improved filtration in an integrated process for reclaiming a high-purity lube oil stock from high-detergent-containing used lubricating oils.

It is another object of this invention to provide a process for efficiently treating used oils containing diesel engine crank case oil.

Other aspects, objects and the advantages of this invention will be apparent to one skilled in the art upon studying this disclosure, the appended claims and the drawing which is a schematic representation of the process of this invention.

STATEMENT OF THE INVENTION

In accordance with this invention a used oil is contacted with an aqueous solution of an ammonium salt treating agent in the presence of a polyhydroxy compound at conditions of temperature and pressure sufficient to allow reaction of the treating agent with ash-forming contaminants of the oil thereby producing a precipitate of reacted contaminants, removing a major portion of water and light hydrocarbon components from the reaction mixture, and separating an oil phase from the precipitate by filtration.

In one embodiment of the invention the separated oil phase is removed from the system as product. In another embodiment of the invention the separated oil phase is subjected to further treatment in an integrated process including the steps of heating the oil resulting from the filtration step to a temperature in the range of about 200° to about 480° C., contacting this heated oil with an adsorbent, hydrotreating the effluent oil from the adsorbtion step, stripping the oil effluent from the hydrotreating step, and recovering the resulting stripped oil as a product of the process.

The polyhydroxy compounds useful in the process of this invention include glycerol; sugar-alcohols such as sorbitol and mannitol; mono-saccharides such as arabinose, glucose and fructose; disaccharides composed of two mono-saccharide units in a glycose linkage such as sucrose; and ethylene glycol. When ethylene glycol is used it is in a sufficiently low concentration to maintain a single phase—preferably not more than 3 volume percent. It is well known that a di-saccharide such as sucrose will hydrolyze to its monosaccharide components, i.e., in the case of sucrose into fructose and glucose.

Although not wishing to be bound by this theory of the invention, it is currently believed that the action of the polyhydroxy compounds in the process of this invention is to agglomerate pre-existing soot particles in the oil, thereby producing a precipitate which is more easily removed along with the particulate matter.

Although larger amounts can be used, for practical considerations the polyhydroxy compounds are added to the oil prior to the precipitation step in a concentration of about 0.1 to about 1.0 weight percent, preferably in the range of about 0.25 to about 0.5 weight percent of the total oil.

The used lubricating oils treated by the process of this invention are primarily the discarded oils that have been used for internal combustion lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils used for the purposes named above are the refined lubricating cuts from paraffin-base, mixed-base, or naphthenic crudes. Their viscosities are generally in the range of from about 100 to about 1,800 SUS at 100° F. The oils also contain various additives such as oxidation inhibitors (e.g., barium, calcium and zinc alkyl thiophosphates, di-t-butyl-p-cresol, etc.), antiwear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylene, poly-(alkylstyrenes), etc.), detergents (e.g., calcium and barium salts of alkyl benzene sulfonic acids) and ashless-type detergents such as alkyl-substituted succinimides, etc.

If desired, water entrained in the untreated used lubricating oil can be removed before use of the oil in the process of this invention. Such a separation can be readily achieved by removal of the water phase which may occur in the storage tanks for the used lubricating oil.

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, as well as mixtures thereof. At present, diammonium hydrogen phosphate is the preferred treating agent.

In addition, if desired, precursors of said ammonium salts can be employed instead of part for all of the ammonium salt. Some examples of these precursors include ammonium thiosulfate, ammonium polyphosphates such as ammonium metaphosphate, urea sulfate, guanidine sulfate, urea phosphate, and guanidine phosphate. Other applicable precursors include reactive combinations of ammonium and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the precursor comprises a combination of such components reactive with each other to give the desired salt in situ, the components of the combination can be introduced at the same time, or either component can be added prior to the introduction of the other component.

Although the concentration of treating agent in the aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be within the range of about 30 to about 95 weight percent, typically about 80 weight percent, of that in an aqueous solution at 25° C. saturated with the treating agent. Frequently some water will be found in used oil, and in these instances the concentration of the treating agent can be adjusted accordingly.

In the process of this invention, the treating agent should be employed in an amount at least sufficient to react with all of the metal constituents in the used oil. Although the weight ratio of the treating agent to the used oil can vary greatly, depending in part upon the nature and concentration of metal-containing components in the oil and on the particular treating agent employed, it generally will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

To illustrate further the overall process of the present invention, the following description is provided which, taken in conjunction with the attached drawing which is a schematic representation of the process, sets forth the presently preferred mode of operation.

Referring now to the drawing, used oil from storage tank 1 is passed through line 3 to heater 5. Aqueous treating agent, preferably diammonium hydrogen phosphate, is passed from storage tank 7 through line 9 in an amount in slight excess of that required to react with the ashforming constituents in the used oil, into admixture with the oil in line 3. Polyhydroxy compound is passed from storage tank 11 through line 13 into admixture with the used oil and treating agent in line 3. After the admixture is heated in heater 5, the resulting hot mixture of oil, polyhydroxy compound, and treating agent is passed by line 15 into contacter 17. In the contacter sufficient agitation is provided, as with paddles or other mixing means, to assure thorough dispersion of the aqueous treating agent and polyhydroxy compound into the oil phase. It is also within the concept of this invention to add the relatively small amounts of treating agent and polyhydroxy compound to the used oil either downstream of the heater 5 into conduit 15 or directly into the contacter 17.

The admixture of used oil, polyhydroxy compound, and aqueous treating agent is maintained in contactor 17 at conditions of temperature and pressure for a period of time sufficient to effect reaction of the treating agent with essentially all of the ash-forming components present in the used oil.

After the ash-forming components in the hot oil have been adequately reacted with a treating agent the reaction mass which has a continuous oil phase is passed by conduit 19 into stripper 21. In an embodiment of the invention, the upper end of stripper 21 is maintained at a temperature and pressure that allows the removal through line 23 of water and light hydrocarbons from the mixture by controlled boiling. These components can be passed to a phase separator (not shown) wherein a hydrocarbon layer and a water layer are allowed to separate with subsequent transfer of material from these layers to separate storage.

A residual mixture having a sulfated ash value of 0.3 to about 10 weight percent (ASTM D 847-72) and which comprises a hot oil phase, which is essentially free of water but which has excess treating agent, and some residual water is passed downwardly through the stripper 21. In the stripper, while not required, it is preferred to maintain the oil at an elevated temperature while steam is introduced to assist in removal of light components and residual water from the system. Thereafter, the resulting stripped hot oil is passed through line 25 to filter 27 to remove suspended and entrained ash-forming matter.

Although a filter aid can be added to the emulsion prior to stripping to assist in the subsequent separation of solids from the essentially water-free oil phase, it is preferable that the filter 27 be precoated with a filter aid selected from among diatomaceous earth, perlite, and cellulose fibers. The presently most preferred filter aid is diatomaceous earth. In addition to precoating the filter it is desirable and preferred to incorporate filter aid into the oil after it has been dried (stripped).

In the presently preferred embodiment of the invention, filter cake is removed by line 29 for further treatment.

Filtered oil, essentially free of ash-forming constituents, i.e., now having a sulfated ash value of about 0.1 to about 0.3 weight percent (ASTM D 847-72) exclusive of excess treating agent or any filter aid which might have passed through the filter, can be removed through line 31 as recovered product without further treatment. Used oil at this point in an overall treating system can be used as a fuel oil, in grease formulations or in the preparation of some types of lubricating oil formulations.

It is presently preferred, however, further to treat the oil product by the process of U.S. Pat. No. 4,151,072. The disclosure of this patent is incorporated here by reference and is further alluded to in the following disclosure.

The hot oil following filtration is passed via line 33 to heater 35 to heat the oil to a temperature in the range of 200°–480° C. If desired, a first portion of hydrogen is added thereto by means of line 36. The resulting hot oil having added hydrogen therein is then passed through contactor 41 wherein decomposition is effected of the sulfonates contained in the oil.

While it is presently preferred that contactor 41 contain bauxite or an activated carbon adsorbent bed therein, this unit can employ other adsorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 41 and to remove the small amount of ash components and highly polar materials present in the low-ash, filtered oil by heating the oil to a temperature within the range of about 300°–410° C., e.g., about 380° C., in the presence of hydrogen and an adsorbent suspended in the oil. After such treatment, the oil is cooled to a temperature within the range of about 60°–200° C., e.g., about 150° C., and refiltered. The same adsorbents cited above for use in fixed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be and often preferably is prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 41 via line 43 to hydrotreater 45, which is maintained at an elevated temperature, which serves to effect destruction of various additive systems previously added to the original oil stock. Hydrogen from source 47 for the desired hydrotreating reaction is introduced to the system by means of line 49 in communication with line 43 or, if desired, directly to the hydrotreater 45.

In hydrotreater 45 the oil is subjected to hydrogenation conditions in the presence of catalyst sufficient to remove unwanted compounds and unsaturated materials and to effect decomposition of residual sulfur, oxygen and nitrogen bodies so as to yield an oil product suitable for further purification to a lube stock.

Suitable catalysts for use in hydrotreater 45 are those selected from the group consisting of Group VIB and Group VIII metals and combinations thereof, on a refractory support, used in conventional hydrodesulfurization processes.

Following hydrotreating, the resulting oil is passed by means of conduit 51 to separator-reflux column 53 which serves to remove water and various other by-products of the previous treatments from the oil. If desired, and particularly when HCl is present, water can be injected into column 53 to aid in removal of most of any HCl and part of the $H_2S$ and $NH_3$ as water-soluble salts. Overhead from column 53 comprising hydrogen, $H_2S$, $NH_3$, and water is passed by means of line 55 to further treatment such as sulfur removal (not shown). Resulting sulfur-free hydrogen can thereafter be passed to ammonia removal, for example by water washing in an ammonia removal unit (not shown) and recycled.

The bottoms product from column 53 is passed via line 57 to lubestock stripper 59 wherein a further steam treatment is carried out.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling, is thereafter passed by means of line 63 to a lube oil stock product tank (not shown) for storage and subsequent use as an additive-free lube oil stock suitable for reformulation with additives as desired.

Overhead from stripper 59, which consists essentially of fuel oil and water, can be passed by means of line 61 to a settler (not shown) where a hydrocarbon phase and a water layer are allowed to form. The hydrocarbon layer is removed and combined, if desired, with the hydrocarbon phase produced from overhead in line 23.

Depending upon the feedstock, treating agent and other characteristics of a particular operation, as one skilled in the art in possession of this disclosure will understand, the specific conditions of operation given below can vary, preferably within the approximate ranges which are also given.

| | | Calculated Operation | |
|---|---|---|---|
| FIG. 1 Ref. No. | Unit Description | Typical | Approximate Preferred Ranges |
| 5 | Heater | Temperature 160° C. | 60–200° C. |
| | | Pressure 215 psia | atmospheric–250 psia |
| 9 | Treating Agent | Weight ratio agt: oil 0.01:1 | 0.005:1–0.05:1 |
| 17 | Contactor | Temperature 160° C. | 60–200° C. |
| | | Pressure 215 psia | atmospheric–250 psia |
| | | Time 30 minutes | 10 minutes–2 hours |
| 21 | Stripper | Top | |
| | | Temperature 160° C. | 60–200° C. |
| | | Pressure 16 psia | 20–2 psia |
| | | Bottom | |
| | | Temperature 115° C. | 60–200° C. |
| | | Pressure 16 psia | 20–2 psia |
| 27 | Filter | Temperature 115° C. | 60–200° C. |
| | | Pressure differential | |

-continued

| FIG. 1 Ref. No. | Unit Description | Calculated Operation Typical | Approximate Preferred Ranges |
|---|---|---|---|
| | | Plate and frame filter 80 psi | 5-100 psi |
| | | Continuous rotary drum filter 10 psi | 2-14 psi |
| 12 | Filter Aid | Weight ratio aid: oil 0.01:1 | 0:1-0.15:1 |
| 33 | Heater | Temperature 370° C. | 200-480° C. |
| | | Pressure 735 psia | 150-3000 psia |
| 36 | Hydrogen Charge | 111 vol/vol oil | 80-3000 vol/vol oil |
| 41 | Adsorber | Temperature 370° C. | 200-480° C. |
| | | Pressure 735 psia | 150-3000 psia |
| 45 | Hydro- | Temperature 360° C. | 200-430° C. |
| | treater | Pressure 730 psia | 150-3000 psia |
| 49 | Hydrogen Charge | 222 vol/vol oil | 80-3000 vol/vol oil |
| 53 | Stripper | Temperature 370° C. | 280-395° C. |
| | | Pressure 20 psia | atmospheric-50 psia |

In the table below there are given typical compositions of the principal streams for the operating conditions above set out.

TABLE I

| Stream No. | 3 | 9 | 19 | 25 | 31 | 49 | 51 | 55 | 57 | 61 |
|---|---|---|---|---|---|---|---|---|---|---|
| Oil | 6644 | | 6644 | 6644 | 6445 | | 6325 | 32 | 6293 | 32 |
| Metals plus P* | 51 | | | | | | | | | |
| S* | 15 | | 13 | 13 | 13 | | <1 | | <1 | |
| O** | 50 | | 45 | 45 | 44 | | <1 | | <1 | |
| N* | 10 | | 10 | 10 | 10 | | <0.1 | | <0.1 | |
| $H_2O$ | 417 | 140 | 557 | | | 2 | 54 | 54 | | 320 |
| $NH_3$ | | | | | | 4 | 20 | 20 | | |
| $H_2S$ | | | | | | | 14 | 14 | | |
| Light hydrocarbons | 300 | | 300 | 150 | 150 | | 275 | 185 | 90 | 90 |
| $(NH_4)_2HPO_4$ | | 70 | | | | | | | | |
| $CH_4$ | | | | | | 67 | 137 | 132 | 5 | 5 |
| $H_2$ | | | | | | 67 | 115 | 114 | 1 | 1 |
| Oil-insolubles | | | 128 | 128 | | | | | | |
| Diatomaceous earth | | | | 70 | | | | | | |

*Present in combined form in the used oil.
**Present in combined form in the used oil, excluding $H_2O$.

The following example illustrates the improvement in filtration rate with addition of a polyhydroxy compound as compared with filtration rates without the addition of polyhydroxy compounds.

EXAMPLE 1

100 g of used oil was heated, with stirring, to 200° F. (93° C.), at which temperature 6 mL of an aqueous solution containing 0.273 g diammonium hydrogen phosphate per mL and a total of 0.5 g sucrose was added. Heating with stirring was continued until the temperature of the mixture reached 350° F. (177° C.), at which time 1 g diatomaceous earth was added. The mixture was then stirred at 350° F. (177° C.) for 5 minutes, after which the mixture was filtered at 350° F. (177° C.) through a Buchner funnel precoated with 5 g diatomaceous earth, the precoat having a diameter of 5.8 centimeters. The filtration rate was 6.5 gal/hr-ft$^2$. In contrast, when the whole procedure was carried out in like manner except that no sucrose was employed, the filtration rate was only 4.9 gal/hr-ft$^2$. In similar tests, with and without addition of sucrose, but with heating to 650° F. before cooling and filtering at 350° F. the filtration rate without sucrose was 5.9 gal/hr-ft$^2$ and with sucrose addition it was 10.2 gal/hr-ft$^2$.

TABLE II

| Type Run | no heat treatment Standard | no heat treatment Sucrose Added | heated to 650° F. Standard | heated to 650° F. Sucrose Added |
|---|---|---|---|---|
| Filtration rate, gal/hr-ft$^2$ | 4.9 | 6.5 | 5.9 | 10.2 |
| Sulfated ash in filtrate, wt. % | 0.11 | 0.10 | 0.01 | 0.01 |

Further to illustrate the use of polyhydroxy compounds as additives in reclaiming used lubricating oils studies were made to compare sucrose and ethylene glycol as additives for improving filtration rates in demetallizing diesel oils. The results of Example 2 reported below illustrate that ethylene glycol is equally as effective as sucrose for improving filtration rates in demetallizing diesel oils.

EXAMPLE 2

200 grams of waste crank case oil was placed into a 600 mL beaker. The used oil was heated to 200° F. with stirring and 10 mL of a 0.273 gm/mL $(NH_4)_2HPO_4$ solution and one gram of sucrose dissolved in 10 mL of distilled water were added with stirring. The heating was continued slowly to raise the temperature to 250° F. with more rapid rise in temperature thereafter to 350° F. The mixture was then transferred to a 500 mL flask and heated with stirring under nitrogen blanket to 650°-680° F. for 30 minutes. The solution was cooled to 450° F. and 2 grams of FP4, a diatomaceous earth filter aid, was added. The mixture was further cooled to 350° F. and a 5.8 cm Buchner funnel precoated with 5 g of FP4 was filled brim full and the filtration time measured from the time of the first drop through the time of the first dry spot filter. 52 mL of filtrate was recovered in a time of 2 minutes, 32 seconds, for a filtration rate of 10.4 gal/hr-ft$^2$.

A comparison run was completed using ethylene glycol in place of sucrose as the filtration improving additive but otherwise using exactly the same conditions and amounts of materials as in the preceding test. Using the ethylene glycol 53 mL of filtrate was recovered and a filter time of 2 minutes, 42 seconds, for a filtration rate of 11.0 gal/hr-ft$^2$.

As a further comparison another test was run using exactly the same amounts of material and conditions but using no additive to improve the filtration rate. In this test 50 mL of filtrate was recovered and a filter time of 5 minutes, 35 seconds, for a filtration rate of 5.0 gal/hr-ft$^2$.

These results are presented in Table III below for easy comparison.

TABLE III

| Additive | Filter time, min:sec | Filtrate recovered, mL | Filtration rate, gal/hr-ft$^2$ |
|---|---|---|---|
| sucrose | 2:32 | 52 | 10.4 |
| ethylene glycol | 2:42 | 53 | 11.0 |
| none | 5:35 | 50 | 5.0 |

The results of the above test show that the filtration rate achieved with both sucrose and ethylene glycol were better than double that achieved without a filtration improving additive and that the sucrose and ethylene glycol showed good equivalence.

We claim:

1. In a process for removing ash-forming contaminants from a used oil by contacting said contaminated oil with an aqueous solution of an ammonium salt treating agent to form a precipitate of reacted contaminants, a method for facilitating removal of the precipitate, said method comprising contacting said treating agent with ash-forming contaminants in the oil in the presence of a polyhydroxy compound.

2. A method of claim 1 wherein said polyhydroxy compound is chosen from among the group consisting of glycerol, sugar-alcohols, mono-saccharides, di-saccharides, and ethylene glycol.

3. A method of claim 1 or 2 wherein the polyhydroxy compound is present in a concentration of about 0.1 to about 1.0 weight percent of the total oil mixture.

4. A method for treating used oil comprising:

(a) contacting said used oil with an aqueous solution of an ammonium salt treating agent in the presence of a polyhydroxy compound at conditions of temperature and pressure sufficient for reaction of the treating agent with ash-forming contaminants of the oil thereby producing a precipitate of reacted contaminants, (b) removing a major portion of water and light hydrocarbon components from the reaction mixture, and (c) separating an oil phase from the precipitate by filtration.

5. A method of claim 4 wherein said oil phase is removed from the system as product.

6. A method of claim 4 wherein said separated oil phase is subjected to further treatment comprising:

(d) heating said separated oil phase to a temperature in the range of about 200° to about 480° C., (e) contacting heated, separated oil phase with an adsorbent, (f) hydrotreating the oil effluent from the contacting with adsorbent, (g) stripping the oil effluent from the hydrotreating step, and (h) recovering the resulting stripped oil as a product.

7. A method of claim 4, 5 or 6 in which the polyhydroxy compound is chosen from among the group consisting of glycerol, sugar-alcohols, mono-saccharides, di-saccharides, and ethylene glycol.

* * * * *